US005125246A

United States Patent [19]

Shytles

[11] Patent Number: 5,125,246

[45] Date of Patent: Jun. 30, 1992

[54] KNITTED ELASTIC LOCK PILE FABRIC

[75] Inventor: Douglas M. Shytles, Shelby, N.C.

[73] Assignee: Shelby Elastics, Inc., Shelby, N.C.

[21] Appl. No.: 557,650

[22] Filed: Jul. 25, 1990

[51] Int. Cl.[5] ..... D04B 23/08

[52] U.S. Cl. ..... 66/193; 66/191; 66/195; 66/75.1

[58] Field of Search ..... 66/190, 191, 193, 194, 66/195, 75.1

[56] References Cited

U.S. PATENT DOCUMENTS

| | | | |
|---|---|---|---|
| 2,369,651 | 2/1945 | Amidon | 66/193 |
| 3,314,251 | 4/1967 | Bünger | 66/193 |
| 3,603,117 | 9/1971 | Svoboda et al. | 66/193 |
| 3,845,641 | 11/1974 | Waller | 66/193 X |
| 4,189,931 | 2/1980 | Groshens | 66/193 |
| 4,818,316 | 4/1989 | Weinle et al. | 66/193 X |
| 4,838,044 | 6/1989 | Matsuda et al. | 66/190 |

FOREIGN PATENT DOCUMENTS

| | | | |
|---|---|---|---|
| 469702 | 12/1928 | Fed. Rep. of Germany | 66/193 |
| 209844 | 1/1924 | United Kingdom | 66/190 |

*Primary Examiner*—Werner H. Schroeder
*Assistant Examiner*—John J. Calvert
*Attorney, Agent, or Firm*—Mason, Fenwick & Lawrence

[57] ABSTRACT

An elastic knit fabric has pile loops on its back surface which are aligned in rows along the linear axis of the fabric and across the transverse axis of the fabric, the loops being disposed in standing relation with the openings in successive transverse rows being canted in opposite directions. The base web forming the fabric has successive courses parallel to its transverse axis and a plurality of parallel wales parallel to its linear axis. The pile yarns are knit to form a plurality of pile loops in the base web, each pile yarn having two stitches knit in successive first and second courses in a first wale, followed by two stitches knit in successive third and fourth courses in a second wale adjacent the first wale, followed by two stitches knit in successive fifth and sixth courses in the first wale. The pile loops are formed by the underlap as the pile yarn crosses back and forth between the first and second wales, whereby each pile yarn forms a pile loop every two courses. The base web comprises a plurality of needle yarns, each of which forms a stitch in an individual wale in each course, a plurality of elastomer yarns, each of which is laid in a wale, and top and bottom lay-in yarns traversing the entire width of the fabric. The pile loops are locked into the stitches formed by the needle yarns.

11 Claims, 2 Drawing Sheets

KNITTED ELASTIC LOCK PILE FABRIC

BACKGROUND AND OBJECTS OF THE INVENTION

The present invention relates in general to pile fabric, and more particularly to knitted elastic lock pile fabrics. The invention is concerned with a unique elastic knit fabric having pile loops on its back surface which are aligned in rows along the linear axis of the fabric and across the transverse axis of the fabric, the loops being disposed in standing relation with the openings in successive transverse rows being canted in opposite directions so that the fabric may be used as the loop portion of a hook and loop fastening system.

Heretofore, it has been common to produce elastic knit fabrics on generic warp knitting machines such as tricot and raschel machines. More recently a number of specialized, narrow width machines have been developed especially for making narrow tapes and elastic webbings. These machines, with names such as raschelina and crochet, are essentially small versions of raschel machines and they incorporate various needle types such as spring beard, latch and compound needles. Elastic fabrics made on these machines usually contain various normal textile yarns along with elastomer yarns such as rubber, latex or spandex. The knitted structure allows for considerable lengthwise extension when stressed and the elastomer gives the recovery to the fabric upon relief of stress.

The purpose of the present invention is to make a knitted elastic webbing that has a loop pile surface on one side. The loops can be regulated in height and spacing and are locked in the fabric so that they may serve as the loop portion of a hook and loop fastener. The pile loops are locked into the knitted stitch at each end so one loop will not rob thread from the adjacent loops and will return to its knitted shape and size upon removal of any stress it has undergone. The pile loops may be made from various types of yarn for special effects. For a pile fabric to serve as a fastener member it is desirable that the loops have considerable rigidity; thus, monofilament yarns are preferred but yarns such as bi-filament, tri-filament or various multi-filaments can be used for the pile. The body of the fabric can be made from any material such as nylon, polyester or polypropylene depending on aesthetic and technical characteristics desired in the finished product. Any type of elastomer can be used such as rubber, latex or spandex of suitable denier for the machine used.

A unique feature of the fabric of the present invention is that it is particularly suitable for providing a narrow knitted fabric providing an elastic band or fabric zone that is receptive to the hook portion of a VELCRO TM hook and loop fastening system, to provide a hook and loop fastening system for health care products, such as incontinent garments where hook and loop fastening is desired.

DETAILED DESCRIPTION OF A PREFERRED EMBODIMENT

The novel elastic pile fabric of the present invention may be generally described as an elastic knit fabric having pile loops on its back surface which are aligned in rows both along the linear axis of the fabric and across the transverse axis of the fabric. The loops are char-standing with the openings in successive transverse rows being canted in opposite directions so that the fabric may be used as the loop portion of a hook and loop fastening device, such as a velcro hook and loop fastening system. To give lengthwise elasticity to the fabric, elastomer yarns are placed in each wale by a lay-in movement of the guiding bars. The fabric may be made in varying widths depending on the number of needles used and/or the number of threads used. Pile height is controlled by using a machine with a lancer bar and lancer points whose thickness can be varied to give larger or smaller loops. It is contemplated that lancer points of 2.5 mm height could be used in a preferred embodiment, but for some purposes either lower or higher lancer points would be used to produce the desired loop height. It is also possible in some machines to use wires instead of the lancer points with the diameter of the wire controlling the pile height.

Figure 1:
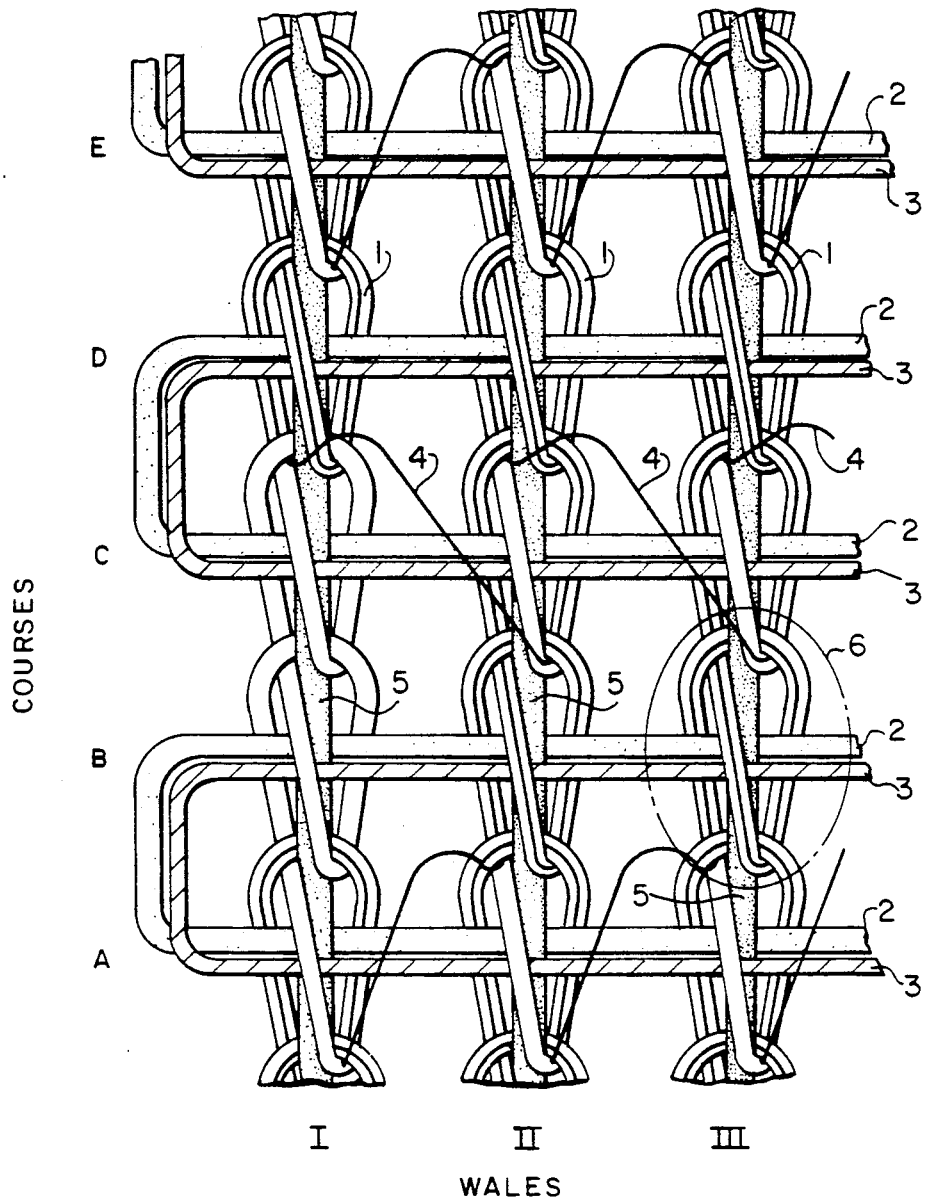
FIG. 1 is a greatly enlarged fragmentary elevational view of a portion of the knit fabric of the present invention, looking at the back or inside, sometimes referred to as a stitch pattern diagram.

FIG. 1 illustrates in very large scale a fragment of the fabric showing three wales and five courses. The wales are numbered at the base of the figure as I, II and III, but may be extended to any number to produce the desired width of the elastic fabric. The courses are lettered A, B, C, D and E to show the length of the fabric. Four courses are required to complete one vertical pattern repeat. A circle designated by the number 6 shows one complete stitch in the fabric.

As shown in FIG. 1, the needle yarn, indicated by the reference character 1, forms a stitch in an individual wale each course. The bottom lay-in or weft yarn, indicated by the reference character 2, traverses the entire width of the fabric from left to right on one course and back from right to left on the next course, being trapped between the face loop of the stitch and the elastomer yarn. The top lay-in yarn, indicated by the reference character 3, traverses the same as the bottom lay-in yarn but is on top of the elastomer and is trapped between the elastomer and the back leg of the loop (commonly referred to as the "under-lap"). The pile yarn, indicated by reference numeral 4, knits two stitches in one wale so that it is locked in, then moves to an adjacent wale to knit two stitches. The pile loop is formed by the under-lap as it crosses from one wale to the adjacent wale. The elastomer yarn 5 is laid in each wale being trapped by the top and bottom lay-in yarns 2 and 3, and also by the under-lap of the needle yarn 1. The fabric illustration of FIG. 1 is the technical backside of the fabric with course A being knit first by this machine, and subsequently courses B, C, D and E are knit.

Figures 2A, 2B, 2C, 2D:
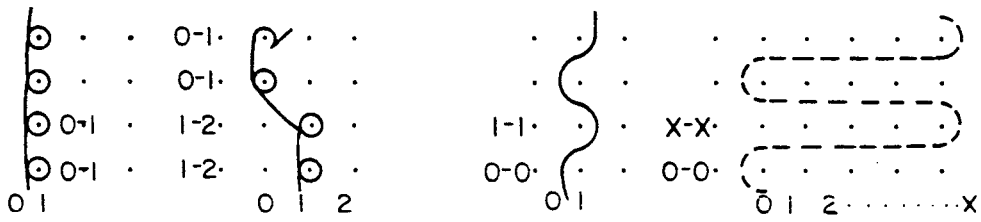
FIGS. 2*a* through 2*d* are knitting notation diagrams for knitting the fabric of the present invention.

FIGS. 2*a* through 2*d* show a tricot notation diagrams of each yarn in the fabric. That allows one who is experienced in the warp knitting art to understand the movements of the guide bars to produce the fabric. As is common, the spaces between the vertical rows of dots represent the spaces between the needles the spaces between horizontal rows of dots represent successive courses in the knitting cycle. Each course in a repeat is designated by two numbers indicating which needle space the guide traveled through to place yarn in a needle and which space it came out through. FIG. 2*a* represents the path of the needle yarn and shows that the knitting cycle, for this yarn is two courses designated 0-1 and 0-1. FIG. 2*b* represents the path of the pile yarn and indicates it has a four course repeat which is 1-2; 1-2; 0-1; 0-1. FIG. 2*c* represents the path of the elastomer yarn and repeats on two courses as 0-0 and 1-1. Both of the lay-in yarns represented in FIG. 2*d* follow the same path and are designated as 0-0 and X-X since the width of the fabric could cover a varying number of needles.

Figure 4:
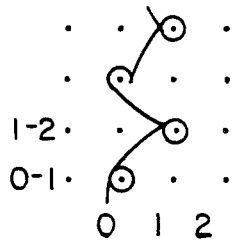
FIGS. 4, 5*a* and 5*b* illustrate normal tricot pattern notations for other constructions closely related to that of FIGS. 1–3, the examples of the knitting notation shown in FIGS. 4, 5*a*, and 5*b* being only the notation for the pile as shown, it being understood of the yarns in the body may be incorporated in a widely varying manner.

The fabric in the preferred embodiment has a pile loop between adjacent wales every second course; however, one who is versed in the knitting art would know that they could be repeated in different ways, that is a single course or more than two courses. FIG. 4 show tricot notation for a method of producing a pile loop every course between adjacent wales but with the ends of the pile loop tied only in one stitch.

Figure 5A:
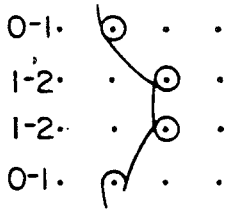
Figure 5B:
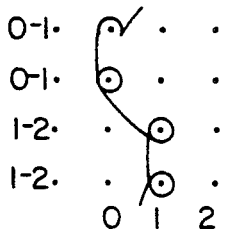

FIGS. 5*a* and 5*b* incorporate two pile yarns for each wale and would also produce a pile loop each course between adjacent wales with each pile loop tied in two courses. FIG. 5*a* would be tricot notation for a first set of pile yarns with a stitch of 0-1; 1-2; 1-2; 0-1 with FIG. 5*b* showing a second set of pile yarns in the same fabric with a stitch of 1-2; 1-2; 0-1; 0-1.

The base elastic fabric onto which the pile loops are attached is previously known and could be varied in many ways. The invention could be applied to most common warp knit elastic fabrics.

Figure 3:
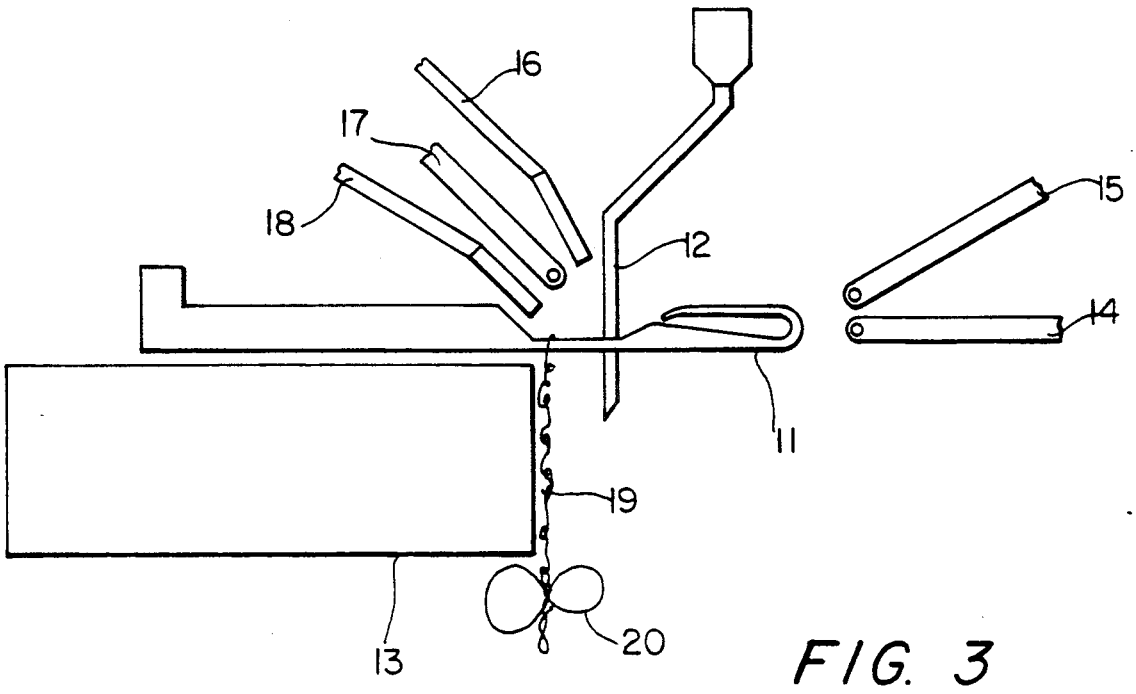
FIG. 3 is an example, in somewhat diagrammatic form, of a machine configuration that can be used to make the fabrics.

FIG. 3 shows a profile view of a knitting machine configuration that could be used to produce the inverted fabric. It has a needle 11 contained in a bed 13 and shows the placement of the lancer bar with its points which are indicated by the reference numeral 12. There are five yarn guide bars to carry the warp yarns and weft yarns. The main stitch yarn is in guide 14 and the pile yarn is carried by guide 15. The top lay-in or weft yarn is in guide 16 and the bottom lay-in is in guide 18 with the elastomer carried by guide 17. The fabric 19 travels downwardly as it is pulled by the take-up rollers 20. Machines having latch needles or compound needles may also be used to produce this novel fabric.

I claim:

1. An elastic warp knit lock pile fabric having a linear axis extending longitudinally, a transverse axis perpendicular to said linear axis and spanning said fabric, and a predetermined width in the direction of said transverse axis, said fabric comprising:

a plurality of yarns knit to form a base web having successive courses parallel to said transverse axis and a plurality of parallel wales parallel to said linear axis; and a set of pile yarns knit to form a plurality of pile loops in said base web, each pile yarn repeat having two stitches knit in successive first and second courses in a first wale, followed by two stitches knit in successive third and fourth courses in a second wale adjacent said first wale, a first pile loop being formed by an underlap as said pile yarn crosses from said first wale to said second wale, and a second pile loop being formed by another underlap as said pile yarn crosses back from said second wale to said first wale, whereby each said pile yarn forms a pile loop every two courses.

2. The fabric of claim 1, wherein said base web comprises:

a plurality of needle yarns, each said needle yarn forming a stitch in an individual wale in each course, each said stitch forming a face loop and an underlap;

a plurality of elastomer yarns, one of said elastomer yarns being laid in each said parallel wale;

a bottom lay-in yarn traversing the entire width of said fabric in a first direction on one course and a second direction opposite said first direction on a successive course, said bottom lay-in yarn being under said elastomer yarns and trapped between said face loops of said stitches and said elastomer yarns; and a top lay-in yarn traversing the entire width of said fabric in a first direction on one course and a second direction opposite said first direction on a successive course, said top lay-in yarn being on top of said elastomer yarns and trapped between said elastomer yarns and said underlaps of said stitches;

wherein said pile loops are locked into said stitches formed by said needle yarns, whereby one of said pile loops will not rob said pile yarn from adjacent ones of said pile loops when subjected to stress and will return to its knitted shape and size upon removal of the stress.

3. The fabric of claim 1, wherein said pile loops have a height regulated by traversing said pile yarn from wale to wale across a raised surface.

4. The fabric of claim 1, wherein said pile yarn is a monofilament yarn.

5. The fabric of claim 1, wherein said pile yarn is a multi-filament yarn.

6. The fabric of claim 1, wherein said pile loops have openings, said openings in successive courses being canted in opposite directions.

7. An elastic warp knit lock pile fabric having a linear axis extending longitudinally, a transverse axis perpendicular to said linear axis and spanning said fabric, and a predetermined width in the direction of said transverse axis, said fabric comprising:

a plurality of yarns knit to form a base web having successive courses parallel to said transverse axis and a plurality of parallel wales parallel to said linear axis; and a first and second set of pile yarns knit to form a plurality of pile loops in said base web, each pile yarn repeat in said first set having two stitches knit in successive first and second courses in a first wale, followed by two stitches knit in successive third and fourth courses in a second wale adjacent said first wale, a first pile loop being formed by an underlap as said pile yarn crosses from said first wale to said second wale, and a second pile loop being formed by another underlap as said pile yarn of said first set crosses back from said second wale to said first wale, each pile yarn in said second set forming a repeat having one stitch knit in a first course in said second wale, two stitches knit in successive second and third courses in said first wale, followed by one stitch knit in a fourth course in said second wale, a third pile loop being formed by an underlap as said pile yarn of said second set crosses from said first wale to said second wale, and a fourth pile loop being formed by another underlap as said pile yarn of said second set crosses back from said second wale to said first wale, whereby each said pile yarn in said first and second sets forms a pile loop every two courses, each wale has two pile yarns knit therein, and said pile loops have openings lining up in rows across said fabric from side to side at every course.

8. The fabric of claim 7, wherein said base web comprises:

a plurality of needle yarns, each said needle yarn forming a stitch in an individual wale in each course, each said stitch forming a face loop and an underlap;

a plurality of elastomer yarns, one of said elastomer yarns being laid in each said parallel wale;

a bottom lay-in yarn traversing the entire width of said fabric in a first direction on one course and a second direction opposite said first direction on a successive course, said bottom lay-in yarn being under said elastomer yarns and trapped between said face loops of said stitches and said elastomer yarns; and a top lay-in yarn traversing the entire width of said fabric in a first direction on one course and a second direction opposite said first direction on a successive course, said top lay-in yarn being on top of said elastomer yarns and trapped between said elastomer yarns and said underlaps of said stitches;

wherein said pile loops are locked into said stitches formed by said needle yarns, whereby one of said pile loops will not rob said pile yarn from adjacent ones of said pile loops when subjected to stress and will return to its knitted shape and size upon removal of the stress.

9. The fabric of claim 7, wherein said pile loops have a height regulated by traversing said pile yarn from wale to wale across a raised surface.

10. The fabric of claim 7, wherein said pile yarn is a monofilament yarn.

11. The fabric of claim 7, wherein said pile yarn is a multi-filament yarn.

* * * * *